US008083333B2

(12) United States Patent
Freitag et al.

(10) Patent No.: US 8,083,333 B2
(45) **Date of Patent: *Dec. 27, 2011**

(54) INK UMBILICAL INTERFACE TO A PRINTHEAD IN A PRINTER

(75) Inventors: Chad David Freitag, Portland, OR (US); David Roland Koehler, Sherwood, OR (US); Edward Charles Grenier, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 619 days.

This patent is subject to a terminal disclaimer.

(21) Appl. No.: 12/271,998

(22) Filed: Nov. 17, 2008

(65) Prior Publication Data

US 2010/0123762 A1 May 20, 2010

(51) Int. Cl.
*B41J 2/175* (2006.01)

(52) U.S. Cl. ..... 347/85

(58) Field of Classification Search ..... 347/85, 347/84, 86, 87, 88, 93, 95, 99, 34, 35, 22
See application file for complete search history.

(56) References Cited

U.S. PATENT DOCUMENTS

| | | | | |
|---|---|---|---|---|
| 5,732,751 | A | 3/1998 | Schmidt et al. | |
| 6,033,452 | A | 3/2000 | Fina et al. | |
| 6,089,698 | A | 7/2000 | Temple et al. | |
| 6,290,349 | B1 | 9/2001 | Silverbrook et al. | |
| 7,959,277 | B2 * | 6/2011 | Freitag et al. | 347/88 |
| 2005/0200655 | A1 | 9/2005 | Macler et al. | |

* cited by examiner

*Primary Examiner* — Kristal Feggins
(74) *Attorney, Agent, or Firm* — Maginot, Moore & Beck, LLP

(57) ABSTRACT

An ink umbilical interface facilitates removal of the umbilical from a printhead while better preserving the integrity of the interface seal. The ink umbilical interface includes an ink umbilical connector having a plurality of conduits terminating within the connector and a tapered nozzle extending from each conduit in the plurality of conduits, each conduit communicating with a liquid ink reservoir, a backplate of a printhead having a plurality of openings, each opening being positioned to receive one of the tapered nozzles extending from the ink umbilical connector, and at least one sealing member positioned between the backplate and the ink umbilical connector, the sealing member having at least one opening to align with one of the backplate openings and receive one of the tapered nozzles.

20 Claims, 3 Drawing Sheets

INK UMBILICAL INTERFACE TO A PRINTHEAD IN A PRINTER

TECHNICAL FIELD

This disclosure relates generally to ink printers, and more particularly, to solid ink printers that supply melted solid ink to printheads through umbilicals.

BACKGROUND

Solid ink or phase change ink printers conventionally use ink in a solid form, either as pellets or as ink sticks of colored cyan, yellow, magenta and black ink, that are inserted into feed channels through openings to the channels. Each of the openings may be constructed to accept sticks of only one particular configuration. Constructing the feed channel openings in this manner helps reduce the risk of an ink stick having a particular characteristic being inserted into the wrong channel. After the ink sticks are fed into their corresponding feed channels, they are urged by gravity or a mechanical actuator to a heater assembly of the printer. The heater assembly includes a heater that converts electrical energy into heating a melt plate. The melt plate is typically formed from aluminum or other lightweight material in the shape of a plate or an open sided funnel. The heater is proximate to the melt plate to heat the melt plate to a temperature that melts an ink stick coming into contact with the melt plate. The melt plate may be tilted with respect to the solid ink channel so that as the solid ink impinging on the melt plate changes phase, it is directed to drip into the reservoir for that color. The ink stored in the reservoir continues to be heated while awaiting subsequent use.

Each reservoir of colored, liquid ink may be coupled to a print head through at least one manifold pathway. As used herein, liquid ink refers to ink that is in a liquid state, such as melted solid ink or aqueous ink. Melted solid ink refers to ink that is in a solid state at typical room temperatures and that has been heated so it changes to a molten state and remains so when elevated above ambient temperature. The liquid ink is pulled from the reservoir as the printhead demands ink for jetting onto a receiving medium or image drum. The printhead elements, which are typically piezoelectric devices, receive the liquid ink and expel the ink onto an imaging surface as a controller selectively activates the elements with a driving voltage. Specifically, the liquid ink flows from the reservoirs through manifolds to be ejected from microscopic orifices by piezoelectric elements in the print head.

Printers having multiple print heads are known. The print heads in these printers may be arranged so a print head need not traverse the entire width of a page during a printing operation. The print heads may also be arranged so multiple rows may be printed in a single operation. Each print head, however, may need to receive multiple colors of ink in order to print the image portion allotted to the print head.

While independent conduit lines may be used to couple each melted ink reservoir to each of the print heads, such a configuration is very inefficient for routing and retention. Actual distances between the reservoirs and heads are much longer. Also, some conduit lines may be sufficiently long that under some environmental conditions the ink may solidify before it reaches its target print head. Conduits must be flexibly configured and attached to one another to allow relative motion for printer operation and reasonable service access. To address these and other issues, an ink umbilical assembly has been developed. Umbilical assembly refers to a plurality of conduit groupings that are assembled together and be in association with a heater to maintain the ink in each plurality of conduits at a temperature different than the ambient temperature. The term conduit refers to a body having a passageway through it for the transport of a liquid or a gas. The umbilical assembly is flexible enough to enable relative movement between adjacent print heads and between print heads and reservoirs.

A set of conduits may be comprised of independent conduits that are coupled together at each end of the conduits so the conduits are generally parallel to one another along the length of the ink umbilical. Alternatively, the conduits may be extruded in a single structure. A heater may be positioned adjacent to the ink umbilical to transfer heat into the conduits to maintain the ink in its melted state. Each conduit in each set of conduits is coupled at an inlet end to a melted ink reservoir and at an outlet end to a print head. All of the outlet ends of a set of conduits may be coupled to the same print head. Thus, the ink conduit lines remain grouped up to the point where they connect to a printhead, which helps maintain thermal efficiency. Each conduit may carry ink of a different color. As used herein, coupling refers to both direct and indirect connections between components.

A block diagram for an umbilical system that couples four melted ink reservoirs to four printheads in a solid ink printer is shown in FIG. 3. The system 10 includes reservoirs 14A, 14B, 14C, and 14D that are coupled to print heads 18A, 18B, 18C, and 18D through staging areas 16$A_{1-4}$, 16$B_{1-4}$, 16$C_{1-4}$, and 16$D_{1-4}$, respectively. Each reservoir collects melted ink for a single color. As shown in FIG. 3, reservoir 14A contains cyan colored ink, reservoir 14B contains magenta colored ink, reservoir 14C contains yellow colored ink, and reservoir 14D contains black colored ink. FIG. 3 shows that each reservoir is coupled to each of the print heads to deliver the colored ink stored in each reservoir. Consequently, each print head receives each of the four colors: black, cyan, magenta, and yellow, although other colors may be used for other types of color printers and fewer or greater numbers of colors may be used, including various shades of black and gray. In this implementation, the melted ink is held in the high pressure staging areas where it resides until a print head requests additional ink. The spatial relationship between reservoirs and print heads are shown in close proximity in the schematic such that the run length of parallel grouping is not illustrated.

In previously known connectors that couple the outlets of an umbilical to a printhead, the nozzles of the connector are generally cylindrical. To seal the passageway in the printhead into which the nozzles are inserted, an O-ring was seated around each nozzle. During some maintenance procedures, the umbilical needs to be removed from a printhead. On occasion, solidified ink adheres to a nozzle and catches on an O-ring as the nozzle is pulled through the O-ring. The solidified ink makes removal of the umbilical more difficult and, in some cases, may damage an O-ring. In some instances, removal of the straight walled nozzles from a printhead may damage a sealing member if a conduit is removed at a severe angle. Facilitating the removal of an umbilical from a printhead is useful for printer maintenance procedures.

SUMMARY

An ink umbilical connector has been developed that facilitates the removal of an umbilical from a printhead. The ink umbilical interface includes an ink umbilical connector having a plurality of conduits terminating within the connector and a tapered nozzle extending from each conduit in the plurality of conduits, each conduit communicating with a liquid ink reservoir, a backplate of a printhead having a plurality of openings, each opening being positioned to receive one of the tapered nozzles extending from the ink umbilical connector, and at least one sealing member positioned between the backplate and the ink umbilical connector, the sealing member having at least one opening to align with one of the backplate openings and receive one of the tapered nozzles.

The ink umbilical interface may be incorporated within a printer. The printer includes a printhead having a backplate with a plurality of openings, a plurality of liquid ink reservoirs, each reservoir having an outlet, an ink umbilical connector having a plurality of conduits, each conduit having a first end and a second end, the first end of each conduit being connected to the outlet of one liquid ink reservoir in the plurality of liquid ink reservoirs and the second end of each conduit having a tapered nozzle extending from the second end of the conduit past the ink umbilical connector, and at least one sealing member positioned between the printhead backplate and the ink umbilical connector, the sealing member having at least one opening to align with one of the backplate openings and receive one of the tapered nozzles extending from the solid ink umbilical connector.

An ink umbilical interface may also include an air nozzle for coupling the printhead to an air source for purging the printhead. The ink umbilical interface includes an ink umbilical connector having a plurality of conduits terminating within the connector and a tapered nozzle extending from each conduit in the plurality of conduits, each conduit communicating with a liquid ink reservoir, an air nozzle proximate the plurality of tapered nozzles, the air nozzle being coupled to an air source at an inlet, a backplate of a printhead having a plurality of openings, each opening being positioned to receive one of the tapered nozzles extending from the plurality of conduits or the air nozzle proximate the plurality of tapered nozzles, and at least one sealing member positioned between the backplate and the ink umbilical connector, the sealing member having at least one opening to align with one of the backplate openings and receive either a tapered nozzle extending from a conduit or the air nozzle.

BRIEF DESCRIPTION OF THE DRAWINGS

The foregoing aspects and other features of an ink umbilical interface are explained in the following description, taken in connection with the accompanying drawings.

DETAILED DESCRIPTION

Figure 1:
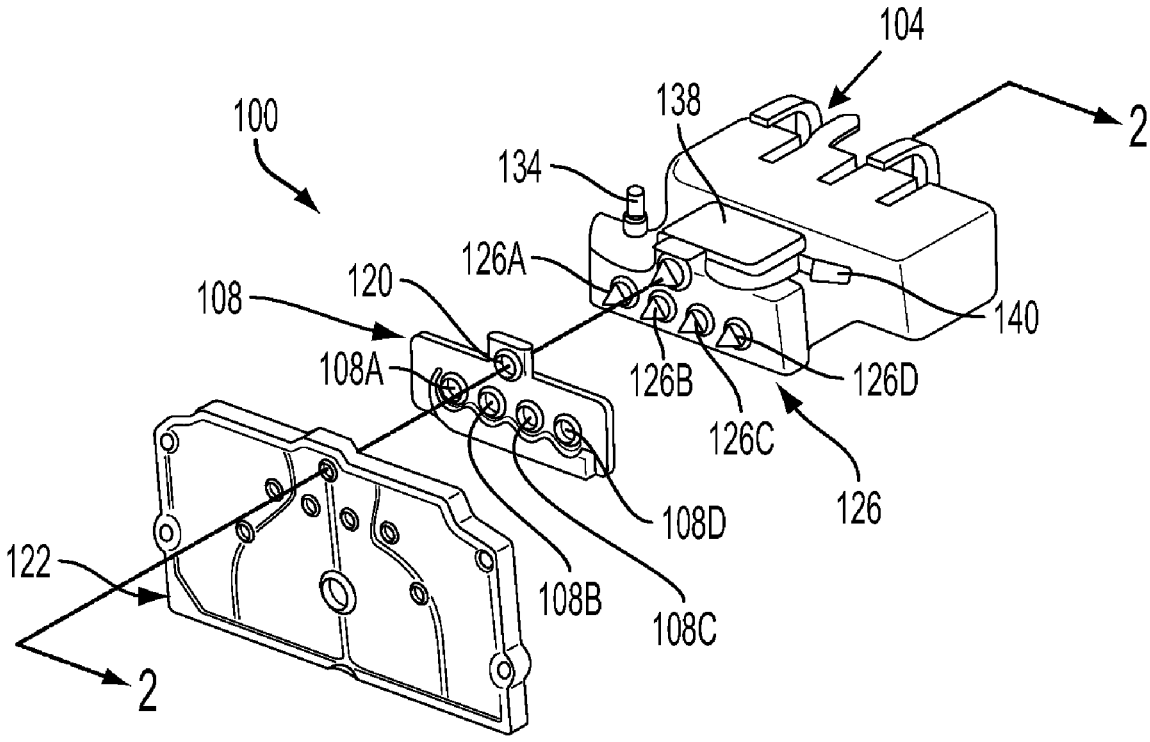
FIG. 1 is an exploded view of an ink umbilical interface for used in a printer.
Figure 3:
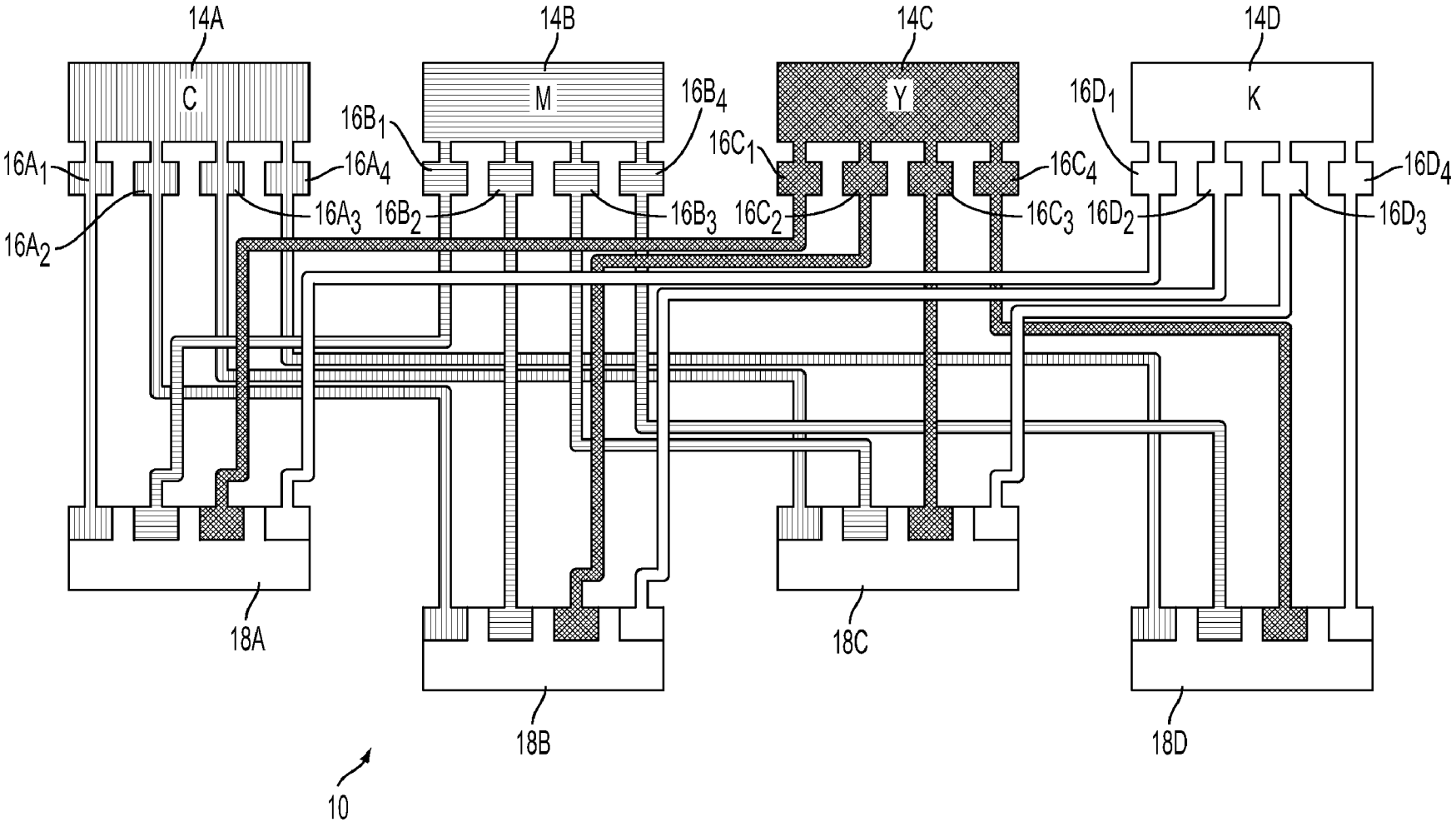
FIG. 3 PRIOR ART
FIG. 3 is a block diagram of connections for an ink delivery system in a printer.

An ink umbilical interface 100 is shown in FIG. 1. The interface 100 includes an umbilical connector 104, a gasket 108, and a printhead backplate 122. The backplate 122 may be mounted to a rear surface of a solid ink printhead that receives melted ink after the ink has been pushed through an umbilical (not shown) so the melted ink exits from the nozzle array 126 and enters the printhead. The umbilical is similar to the one described above with reference to FIG. 3 as it is configured to have four conduits and each conduit contains a different color of melted ink. Each conduit has a terminating end that is coupled to one of the nozzles in the array 126. The structure of the nozzles 126A, 126B, 126C, and 126D is discussed in more detail below. The ink umbilical interface may also be used in other printers having sources of liquid ink, such as aqueous ink or ink emulsions.

The gasket 108 is made of an elastomeric material, such as silicone rubber that has been compression molded, although other materials and construction methods may be used. The gasket 108 includes a number of openings 108A, 108B, 108C, and 108D that corresponds to the number of nozzles in the nozzle array 126. Additionally, the gasket may include an opening that receives a nozzle 134 that is coupled to an air source (not shown). Although the nozzle 134 is shown as being placed within an exit port for an air filter 138, the air filter may be located elsewhere and a conduit carrying the air to the nozzle 134 may be coupled to the nozzle 134 rather than to the inlet 140 of the air filter 138. The gasket 108 may be mounted to the backplate 122 with an adhesive. Screws, spring clamps, or other fasteners or retentions enable the umbilical connector 104 to be coupled to the backplate 122 in a manner that compresses the gasket between them. Compression of the gasket 108 helps seal the openings 108A, 108B, 108C, and 108D through which the nozzles 126A, 126B, 126C, and 126D extend as well as the opening 120 through which nozzle 134 extends.

Figure 2A:
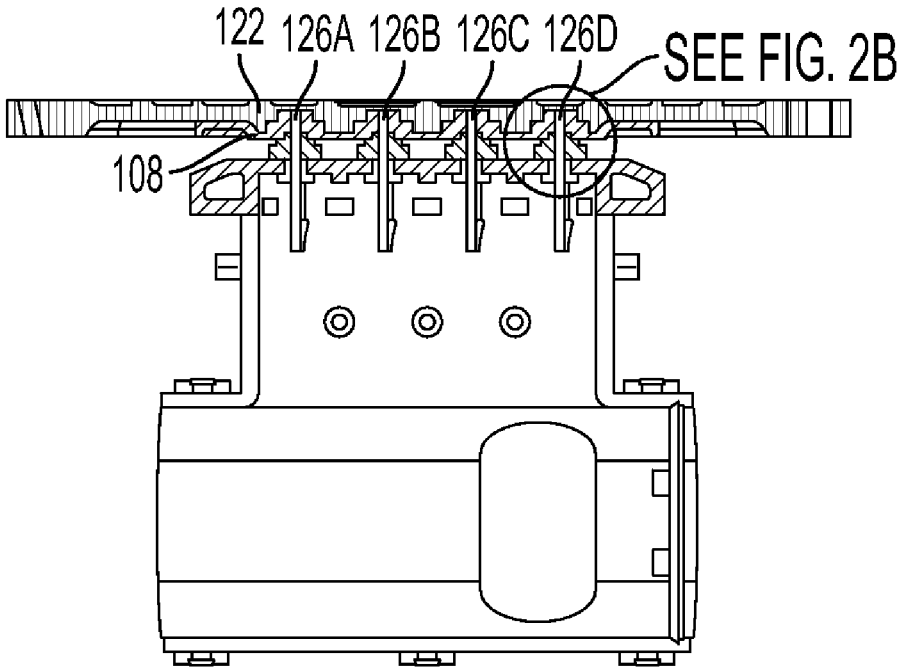
FIG. 2A is a cross-sectional view of the components of the ink umbilical interface when the interface is assembled.
Figure 2B:
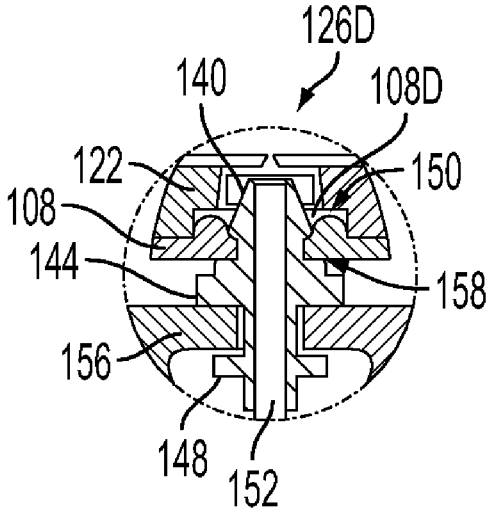
FIG. 2B is a detailed view of the mating of the components of the ink umbilical interface at one of the conduit nozzles in the interface shown in FIG. 2.

The structure of the nozzles 126A, 126B, 126C, and 126D are discussed in more detail with reference to FIG. 2A and FIG. 2B. In FIG. 2A, a cross-section of an assembled umbilical interface taken along line 2-2 in FIG. 1 is depicted. As shown in the figure, the gasket 108 is compressed by the nozzles 126A, 126B, 126C, and 126D as the connector 104 is urged towards the backplate 122 by fasteners (not shown). The structure of individual nozzle 126D is shown in FIG. 2B. A nozzle includes a tapered head 140, a rim 144, and a capture ring 148. Defined within the nozzle is a channel 152. The rim 144 and the capture ring 148 cooperate to secure the nozzle to a faceplate 156 of the connector 104. In fabrication, the connector 104 has an upper and a lower portion. Each nozzle is positioned in an opening in the lower portion so the rim 144 is on the external surface of the faceplate and the capture ring 148 is on the internal surface of the faceplate. The upper portion is then mated onto the lower portion to capture the nozzle in the opening and the two portions are secured to one another. The nozzle may be made of a metal, such as aluminum, that conducts heat from the heater element in the umbilical and from the heater elements in the printhead. In ink umbilicals transporting ink that remains in a liquid state at or near room temperatures, the nozzles may be made of materials that are less thermally conductive.

As shown in FIG. 2B, the base of the tapered head 140 and the rim 144 have two different circumferences to provide a step between the base of the head and the rim. The base of the head, however, may have the same circumference as the rim to provide smooth continuity between the two structures. Additionally, while the tapered head 140 is depicted as being conical, other sloped surfaces may be used, including multi-sided shapes where at least one surface is tapered. Also, the nozzle opening 108D in the gasket 108 is shown as having a circular rib 150 about the opening on the side of the gasket that engages the backplate 122. This rib helps fill the corresponding opening 154 in the backplate.

The structure of the nozzle and the gasket described above provide a number of advantages. For one, the tapered head 140 facilitates the passage of the nozzle through a sealing member during removal of the nozzle head from the backplate of a printhead. The ease of the nozzle's passage through the sealing member is particularly apparent when the nozzle is removed from a cold printhead in a solid ink printer. Because solidified ink in the cold printhead does not significantly bond to the head 140 rather than adhering to the printhead, the head 140 does not pull solidified ink against the gasket opening or the channel through the gasket opening. In previously known designs, cylindrical nozzles pulled solidified ink adhering to them from the backplate against the sealing structure, such as an O-ring, which sometimes damaged the sealing structure. The tapered heads also provide a greater range of tolerance for fitting nozzles into the openings than cylindrical nozzles regardless of the type of liquid ink ejected by the printhead. Another advantage of a single piece gasket construction is the ease of locating the gasket with the backplate and nozzle array of the interface with an improvement in the sealing of the channels around the nozzles. A single piece gasket and the proximate location of the air source nozzle to the ink nozzle array may enable both a melted ink and a purging air source to be coupled to a printhead through the same interface.

In operation, each conduit of an ink umbilical is coupled to an ink nozzle in the ink umbilical connector. If the connector has structure for retaining an air source nozzle, the air source conduit with its terminating nozzle is positioned within the retaining structure. The gasket is mounted to the backplate with an adhesive or the like. The umbilical connector is then mounted to the backplate to enable each ink nozzle and air source nozzle, if included, to enter the corresponding opening for the nozzle in the gasket. As the fasteners are tightened, the gasket provides a radial and face seal for each nozzle so purging air and liquid ink may be supplied to the printhead. Thereafter, the fasteners mounting the connector to the backplate may be loosened and the connector pulled away from the printhead. Even in solid ink printers in which melted ink within the printhead has solidified, the tapered heads enable the nozzles to exit through the gasket without significant risk that the solidified ink adheres to the nozzle and damages the gasket as the nozzle and ink are pulled through the gasket.

It will be appreciated that various above-disclosed and other features and functions, or alternatives thereof, may be desirably combined into many other different systems or applications. Various presently unforeseen or unanticipated alternatives, modifications, variations, or improvements therein may be subsequently made therein by those skilled which are also intended to be encompassed by the following claims.

What is claimed:

1. An ink umbilical interface for coupling an ink umbilical to a printhead comprising:

an ink umbilical connector having a plurality of conduits terminating within the connector and a tapered nozzle extending from each conduit in the plurality of conduits, each conduit communicating with a liquid ink reservoir;

a backplate of a printhead having a plurality of openings, each opening being positioned to receive one of the tapered nozzles extending from the ink umbilical connector; and at least one sealing member positioned between the backplate and the ink umbilical connector, the sealing member having at least one opening to align with one of the backplate openings and receive one of the tapered nozzles.

2. The ink umbilical interface of claim 1, each tapered nozzle includes:

a cylindrical inlet configured to be received within a conduit terminating within the ink umbilical connector;

a rim positioned about the cylindrical inlet at a predetermined distance from one end of the cylindrical inlet; and a conical nozzle extending from the rim.

3. The ink umbilical interface of claim 2, each tapered nozzle further comprising:

a collar separated from the rim by a second predetermined distance, the second predetermined distance corresponding to a thickness for a faceplate of the ink umbilical connector.

4. The ink umbilical interface of claim 1 wherein each tapered nozzle is made of aluminum.

5. The ink umbilical interface of claim 4 further comprising:

at least one conduit communicating with an air source;

a tapered nozzle extending from the conduit; and an opening in the sealing member and an opening in the backplate, the openings in the sealing member and the backplate aligning to receive the tapered nozzle extending from the conduit communicating with the air source.

6. The ink umbilical interface of claim 1 wherein the sealing member is a gasket having a plurality of openings, each opening in the gasket being positioned to align with one of the openings in the backplate and to receive one of the tapered nozzles extending from the plurality of conduits.

7. The ink umbilical interface of claim 6 wherein the gasket is made of an elastomer.

8. A printer comprising:

a printhead having a backplate with a plurality of openings;

a plurality of liquid ink reservoirs, each reservoir having an outlet;

an ink umbilical connector having a plurality of conduits, each conduit having a first end and a second end, the first end of each conduit being connected to the outlet of one liquid ink reservoir in the plurality of melted ink reservoirs and the second end of each conduit having a tapered nozzle extending from the second end of the conduit past the liquid ink umbilical connector; and at least one sealing member positioned between the printhead backplate and the ink umbilical connector, the sealing member having at least one opening to align with one of the backplate openings and receive one of the tapered nozzles extending from the ink umbilical connector.

9. The printer of claim 8, each tapered nozzle extending from one of the conduits includes:

a cylindrical inlet configured to mate with the second end of one of the conduits;

a rim positioned about the cylindrical inlet at a predetermined distance from one end of the cylindrical inlet; and a conical nozzle extending from the rim.

10. The printer of claim 9, each tapered nozzle extending from one of the conduits further comprising:

a collar separated from the rim by a second predetermined distance, the second predetermined distance corresponding to a thickness for a faceplate of the solid ink connector.

11. The printer of claim 8 wherein each tapered nozzle is made of aluminum.

12. The printer of claim 11 further comprising:

at least one conduit communicating with an air source;

a tapered nozzle extending from the conduit; and an opening in the sealing member and an opening in the backplate, the openings in the sealing member and the backplate aligning to receive the tapered nozzle extending from the conduit communicating with the air source.

13. The printer of claim 8 wherein the sealing member is a gasket having a plurality of openings, each opening in the gasket being positioned to align with one of the openings in the backplate and to receive one of the tapered nozzles extending from the plurality of conduits.

14. The printer of claim 13 wherein the gasket is made of an elastomer.

15. An ink umbilical interface for coupling an ink umbilical to a printhead comprising:

an ink umbilical connector having a plurality of conduits terminating within the connector and a tapered nozzle extending from each conduit in the plurality of conduits, each conduit communicating with a liquid ink reservoir;

an air nozzle proximate the plurality of tapered nozzles, the air nozzle being coupled to an air source at an inlet;

a backplate of a printhead having a plurality of openings, each opening being positioned to receive one of the tapered nozzles extending from the plurality of conduits or the air nozzle proximate the plurality of tapered nozzles; and at least one sealing member positioned between the backplate and the ink umbilical connector, the sealing member having at least one opening to align with one of the backplate openings and receive either a tapered nozzle extending from a conduit or the air nozzle.

16. The ink umbilical interface of claim 15, each tapered nozzle includes:

a cylindrical inlet configured to be received within a conduit terminating within the ink umbilical connector;

a rim positioned about the cylindrical inlet at a predetermined distance from one end of the cylindrical inlet; and a conical nozzle extending from the rim.

17. The ink umbilical interface of claim 16, each tapered nozzle further comprising:

a collar separated from the rim by a second predetermined distance, the second predetermined distance corresponding to a thickness for a faceplate of the ink umbilical connector.

18. The ink umbilical interface of claim 15 wherein the sealing member is a gasket having a plurality of openings, each opening in the gasket being positioned to align with one of the openings in the backplate and to receive either one of the tapered nozzles extending from the plurality of conduits or the air nozzle.

19. The ink umbilical interface of claim 18 wherein the gasket is made of an elastomer.

20. The ink umbilical interface of claim 15 wherein the air nozzle includes a tapered nozzle.

* * * * *